US005555960A

United States Patent [19]

Bartsch

[11] Patent Number: 5,555,960

[45] Date of Patent: Sep. 17, 1996

[54] ROLLING TRAVEL CASE

[75] Inventor: Georg Bartsch, Iserlohn, Germany

[73] Assignee: Sudhaus Schloss-Und Beschlagtechnik GmbH & Co., Iserlohn, Germany

[21] Appl. No.: 421,416

[22] Filed: Apr. 13, 1995

[30] Foreign Application Priority Data

Apr. 27, 1994 [DE] Germany ..... 9406969 U
Feb. 16, 1995 [DE] Germany ..... 295 02 521.2

[51] Int. Cl.[6] ..... A45C 5/14; A45C 13/00; A45C 13/26; A45C 13/30

[52] U.S. Cl. ..... 190/115; 190/18 A; 190/39

[58] Field of Search ..... 190/18 A, 39, 190/115, 117, 116; 280/37, 655, 655.1, 47.29; 150/108

[56] References Cited

U.S. PATENT DOCUMENTS

| | | | |
|---|---|---|---|
| 1,979,978 | 11/1934 | Martin | 190/115 |
| 2,392,926 | 1/1946 | Kelly | 190/18 A |
| 2,769,475 | 11/1956 | Fisher | 190/115 |
| 3,275,336 | 9/1966 | Warner, Jr. | 190/115 X |
| 3,653,474 | 4/1972 | Sadow | 190/115 X |
| 3,982,613 | 9/1976 | Wood | 190/18 A |
| 3,995,802 | 12/1976 | Johnston | 190/115 X |
| 4,679,671 | 7/1987 | Kobayashi | 190/115 |
| 4,756,394 | 7/1988 | Cohen | 190/116 X |
| 5,027,874 | 7/1991 | Gazzola | 190/115 X |
| 5,109,961 | 5/1992 | Bergman | 190/115 X |
| 5,169,164 | 12/1992 | Bradford | 190/18 A |
| 5,294,029 | 3/1994 | Shimura et al. | 150/108 X |
| 5,351,793 | 10/1994 | Gibbs | 190/115 |
| 5,435,423 | 7/1995 | Rekuc et al. | 190/18 A |

FOREIGN PATENT DOCUMENTS

| | | | |
|---|---|---|---|
| 425390 | 5/1991 | European Pat. Off. | 190/18 A |
| 2538229 | 6/1984 | France | 190/18 A |
| 2608388 | 6/1988 | France | 190/116 |
| 2641172 | 7/1990 | France | 190/18 A |
| 2645416 | 10/1990 | France | 150/108 |
| 2676628 | 11/1992 | France | 190/115 |
| 4003561 | 2/1991 | Germany | 190/18 A |
| 8901002 | 11/1990 | Netherlands | 190/18 A |
| 2238955 | 6/1991 | United Kingdom | 190/116 |
| 9215219 | 9/1992 | WIPO | 190/18 A |
| 9324029 | 12/1993 | WIPO | 190/115 |

*Primary Examiner*—Sue A. Weaver
*Attorney, Agent, or Firm*—Herbert Dubno; Andrew Wilford

[57] ABSTRACT

A rolling travel case has a body having top and bottom sides, generally vertical front and back ends, and side faces. A plurality of horizontally spaced wheels on the bottom side allow the body to be rolled via the wheels on the ground. A handle is secured to outer ends of a pair of flexible leads each having an inner end secured at a respective rear location on the front end and an outer end secured at a respective front location on the handle. The rear locations are spaced from each other and the front locations are spaced from each other. The rear locations are horizontally spaced on the case. The case is generally symmetrical to a vertical symmetry plane and the rear locations normally symmetrically flank the plane.

14 Claims, 10 Drawing Sheets

ROLLING TRAVEL CASE

FIELD OF THE INVENTION

The present invention relates to a rolling travel case. More particularly this invention concerns a suitcase or similar piece of luggage equipped with wheels and a pull handle or lead.

BACKGROUND OF THE INVENTION

A rolling travel case is equipped with wheels so that it can be rolled rather than carried. The case is normally generally parallepipedal and typically has two opposite large-area faces, two long sides, and two short ends and the wheels are provided on one of the long sides. A flexible lead is attached to an upper region of one of the short ends so that a person can grip the lead's outer end and pull the case. Such a case is very convenient in that it does not have to be lifted and lugged, but instead can be rolled about, at least when the underlying surface is fairly uniform, which requires much less effort than actually carrying it.

The problem with such systems is that the case is frequently relatively tall and narrow and the wheels are relatively small and closely spaced. Thus the case can be set to rocking or wobbling very easily. The centrally connected lead is virtually useless in controlling these movements and a badly timed tug can in fact aggravate them. Thus the only way for the user to stop such movements before the case tips over is to actually lay his or her hand on the case.

OBJECTS OF THE INVENTION

It is therefore an object of the present invention to provide an improved rolling travel case.

Another object is the provision of such an improved rolling travel case which overcomes the above-given disadvantages, that is which allows a user holding the lead to better control the case.

SUMMARY OF THE INVENTION

A rolling travel case has according to the invention a body having top and bottom sides, generally vertical front and back ends, and side faces. A plurality of horizontally spaced wheels on the bottom side allow the body to be roll via the wheels on the ground. A handle is secured to outer ends of a pair of flexible leads each having an inner end secured at a respective rear location on the front end and an outer end secured at a respective front location on the handle. The rear locations are spaced from each other and the front locations are spaced from each other.

Thus with this system it is possible to control the case when towing it fairly easily with the handle. The two points of purchase of the leads on the case makes it easy to exert considerable control. In fact there is an automatic self-steadying effect in that, presuming the handle is being held solidly, if the case tips to one side the lead on that side will become tauter and the one on the other side looser, and the result will be an automatic righting of the case. Normally the rear locations are horizontally spaced on the case. The case is generally symmetrical to a vertical symmetry plane and the rear locations symmetrically flank the plane.

The handle has a pair of deflector pins and hooks that define the front locations. The belts pass around the respective pins and are caught on the respective hooks. If only one pin is provided the handle itself can be relatively soft, an easy-to-grasp loop. Alternately the handle has a pair of stiff parts one of which has a pair of pins and the other of which has a pair of recesses receiving the pins and defining therewith the front locations. The outer ends of the leads are engaged between the parts and traversed by the pins at the front locations. One or more springs are provided in the case for retracting the leads and pulling the handle against the front end. At least one housing mounted on the case contains the spring(s). This housing can have a pair of parts one of which is mounted outside the body and the other of which is mounted inside the body. Fasteners secure the parts together to opposite sides of the front end. Often according to the invention the case is provided with two such housings spaced apart and each holding a respective such spring for the respective lead. This is advantageous when the case itself is formed of two shell halves that meet at the case's symmetry plane. These housings can be mounted externally on the body or inside the body, leaving the entire interior empty. There is normally a respective spring in each housing having one end secured to the respective lead and an opposite end to the respective housing. Each spring can be provided with a clip defining a hole and each housing with a deflector. In this case each belt passes through the hole and over the deflector and has its inner end secured to the clip.

The spring unit according to this invention includes a rotatable single shaft extending through the rear locations. The inner ends of the belts are secured to the shaft at the locations, and a spring engaged between the shaft and the housing rotationally urges the shaft in a direction winding the leads up on the shaft.

The rolling travel case further has according to the invention a socket on the front end and positioned to receive the handle in a retracted position thereof. The front end is provided with a pair of fittings defining seats forming the socket. Each belt is formed adjacent its outer end with a throughgoing eye hole and each fitting is provided with a hook engageable through the respective eye hole. In another arrangement the front end is provided with a downwardly directed hook and the handle has at least one pivot part engageable with the hook for coupling of the handle directly to the body. The front end has two such hooks spaced horizontally from each other and the handle has a pair of rods defining the pivot part and engageable with the respective hooks. This is particularly advantageous when the rolling case of this invention is lashed together with other pieces of luggage.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 2:
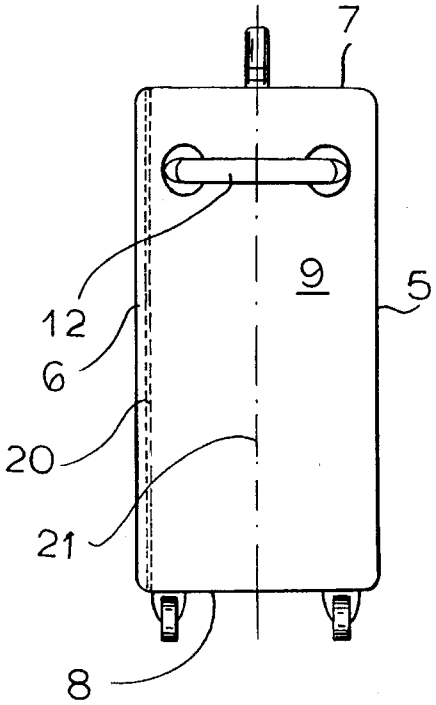
FIG. 2 is a front view of the case with the lead retracted.

As seen in FIGS. 1 through 4 a case 1 according to this invention has a body 2 provided with wheels 3 and a lead assembly 4. The body 2 is generally parallepipedal and has a pair of vertical and rectangular large-area faces 5 and 6, relatively long, horizontal, and rectangular top and bottom sides 7 and 8, and vertical and rectangular front and back ends 9 and 10. A handle 11 is attached centrally to the top side 7 and the wheels 3 are at the corners of the bottom side 8. A slide fastener 20 bounding three edges of the side face 5 allows the case 1 to be opened.

Figure 6:
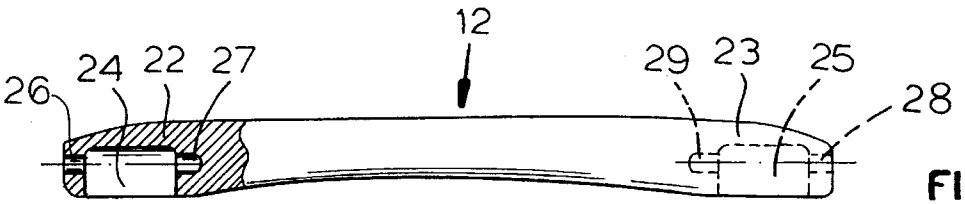
FIG. 6 is a partly sectional side view of the handle.
Figure 7:
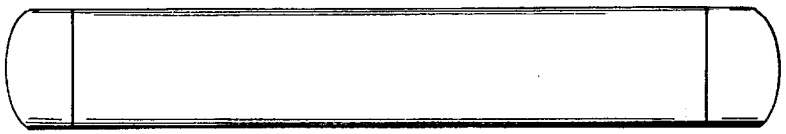
FIG. 7 is a front view of the handle.
Figure 9:
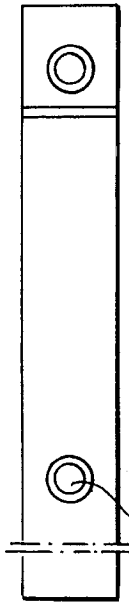
FIG. 9 is a front view of the outer end of the one lead belts.
Figure 5:
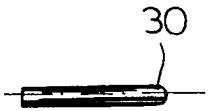
FIG. 5 is a side view of a coupling pin according to the invention.
Figure 8:
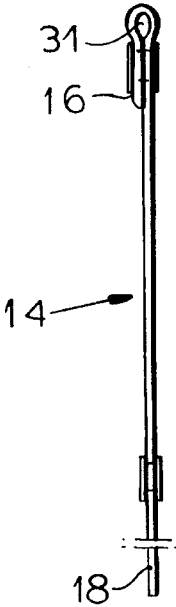
FIG. 8 is a side view of the outer end of one of the lead belts.
Figure 13:
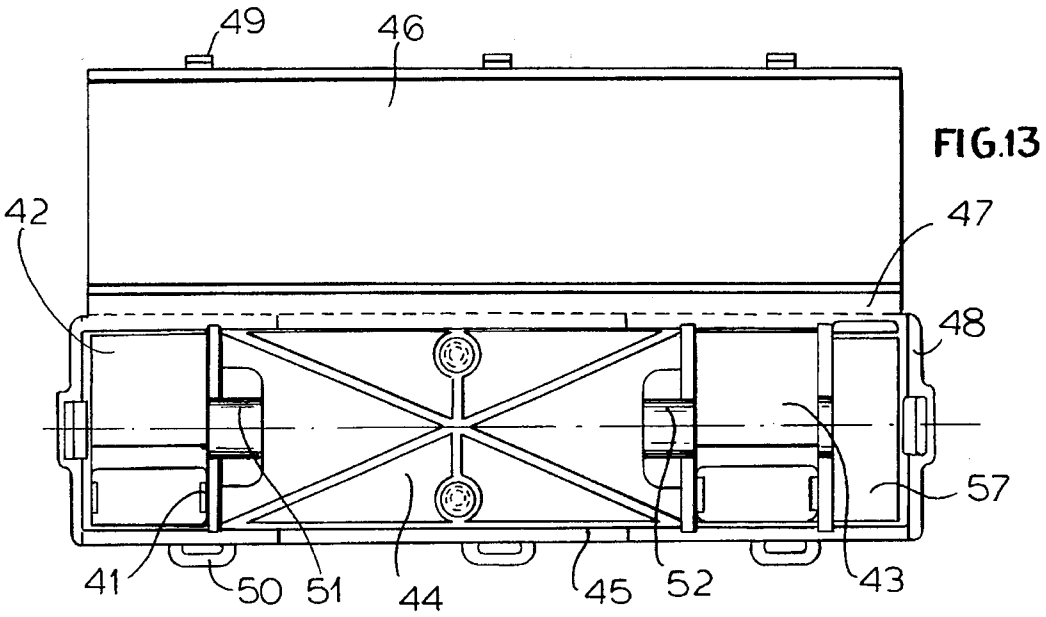
FIG. 13 is a front view of the windup-mechanism housing.
Figure 15:
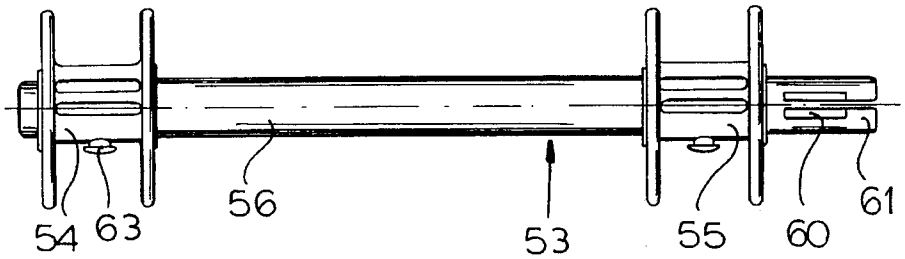
FIG. 15 is a side view of the windup spool.
Figure 12:
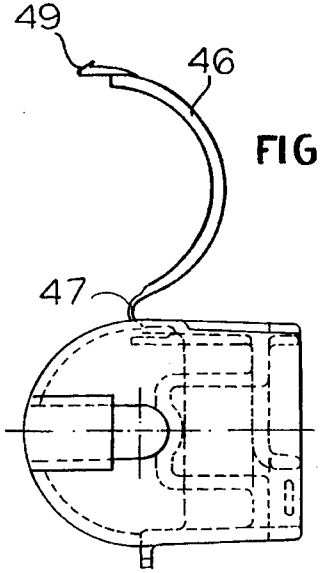
FIG. 12 is a side view of the housing for the windup mechanism.
Figure 14:
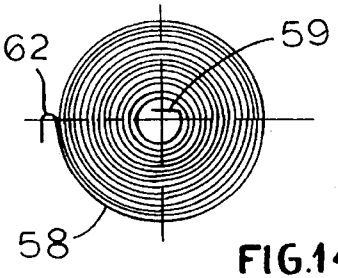
FIG. 14 is an end view of the windup spring.

The lead assembly 4 basically comprises a rigid handle 12 and a flexible lead 13 comprised of a pair of identical straps 14 and 15 having outer ends 16 secured to the handle 12 and inner ends 18 secured to the body 2. The two belts 14 and 15 symmetrically flank a center plane 21 of the body 2. The handle 12 as seen in FIGS. 6 and 7 is elongated and has ends 22 and 23 formed with pockets 24 and 25 and with bores 26, 27; 28, 29 opening thereinto. Pins 30 (FIG. 5) can be seated in the pairs of bores 26, 27; 28, 29. The belt ends 16 and 17 are formed as shown in FIGS. 8 and 9 with loops 31 through which the pins 30 pass when same are mounted in the pockets 24 and 25 to make a very solid connection between the belts 14 and 15 and the handle 12.

Figure 1:
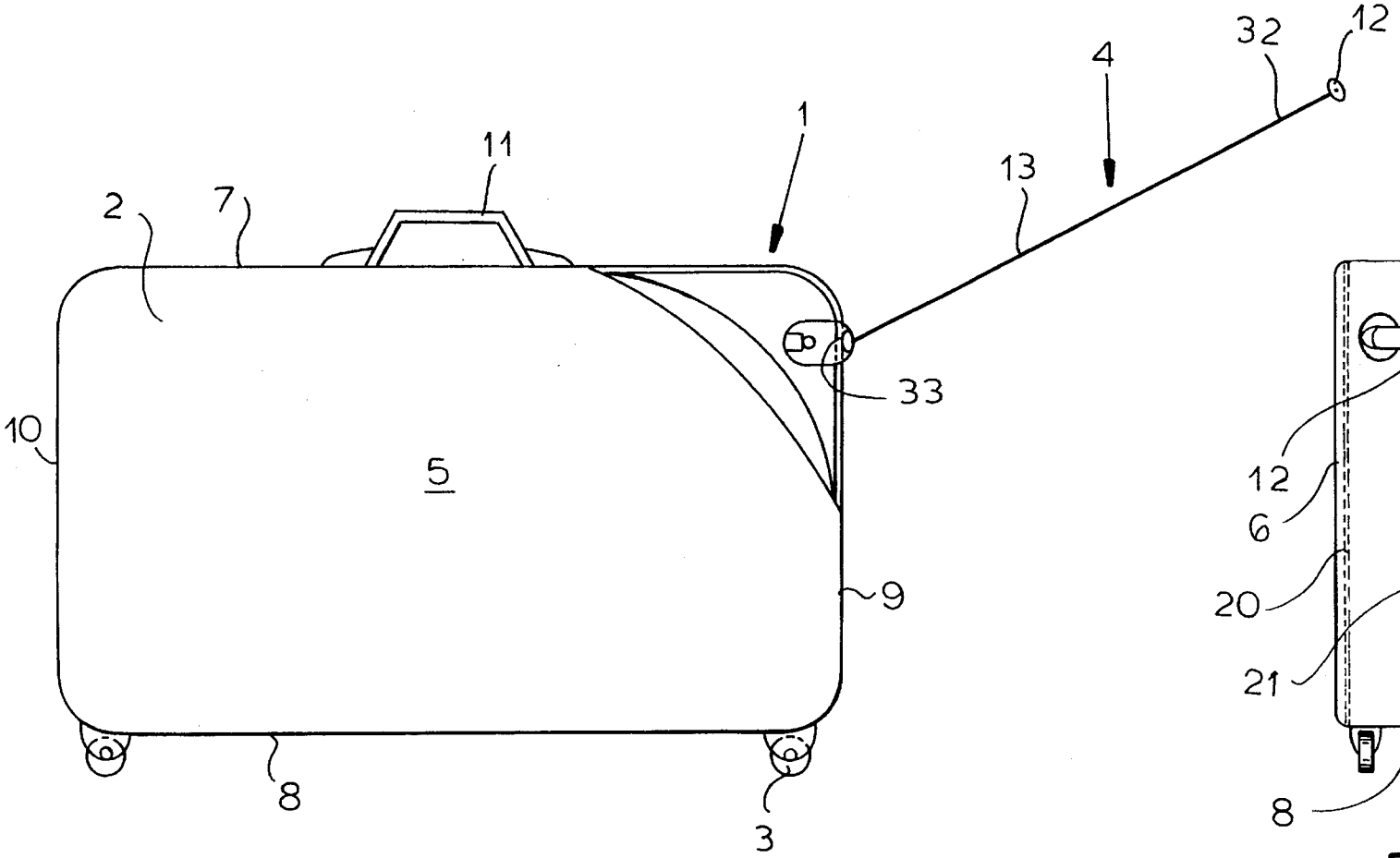
FIG. 1 is a small-scale side view of a case according to the invention with the pull lead extended.
Figure 4:
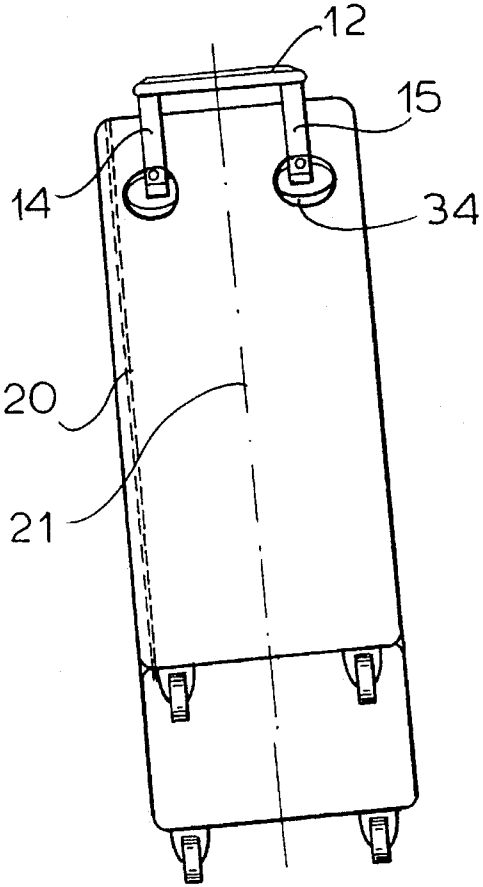
FIG. 4 is a front view of the case as seen in FIG. 3.
Figure 3:
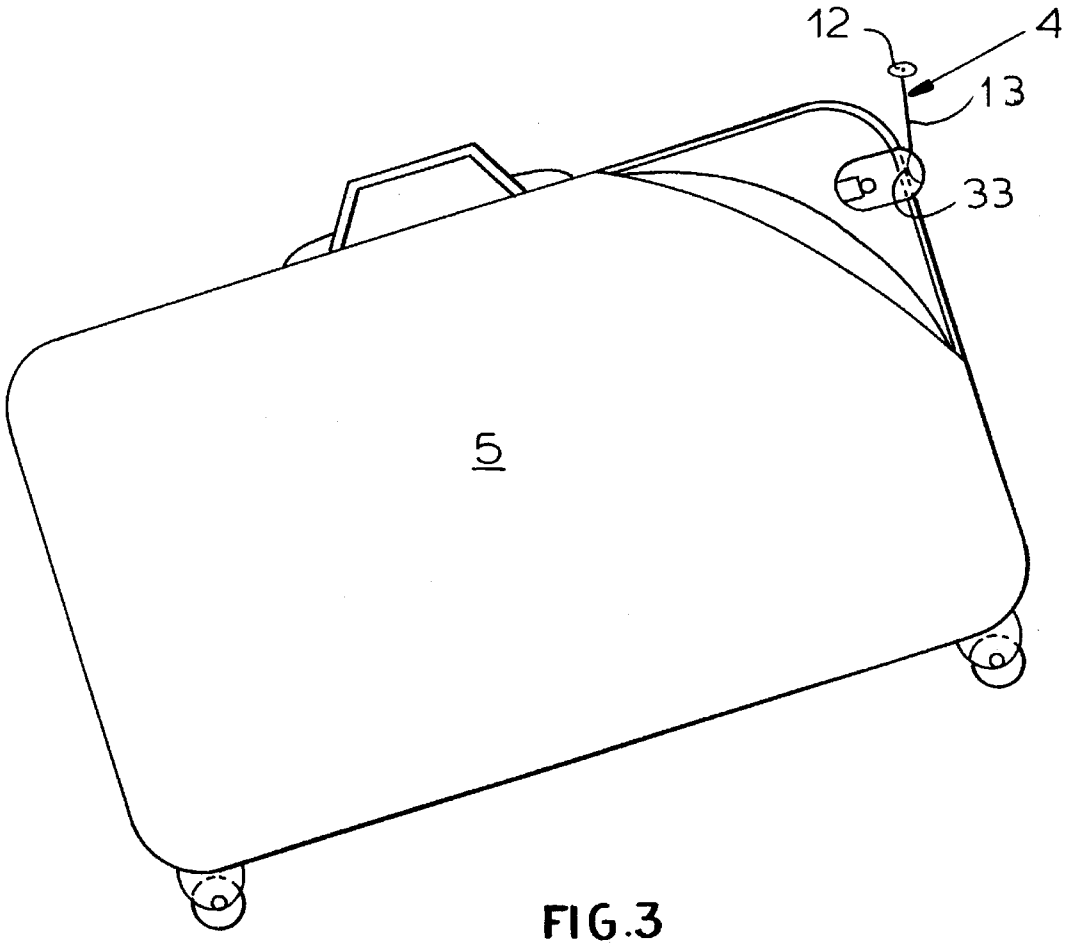
FIG. 3 is a view like FIG. 1 with the front end of the case lifted.
Figure 10:
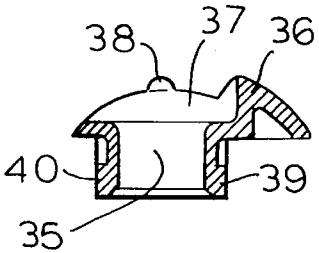
FIG. 10 is a section through one of the handle sockets.
Figure 11:
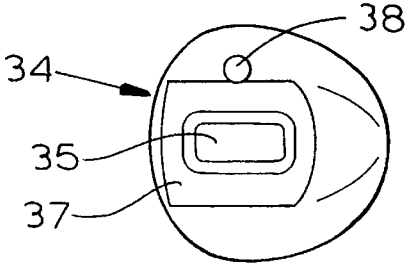
FIG. 11 is a front view of the one handle socket.

In addition each of the lead belts 14 and 15 is centrally formed somewhat inward of its outer end 16 or 17 with an eye or hole 32. The front end 9 is formed with two holes 33 (FIG. 1) through which the belt leads 14 and 15 pass and each such hole 33 is provided with an eye fitting 34 shown in FIGS. 10 and 11 in some detail. This fitting 34 has a throughgoing hole 35 through which the respective belt 14 or 15 passes and a projecting rim 36 defining a seat 37 for the respective handle end 22 or 23. A collar 39 on the fitting 34 has barb formations 40 to anchor it in the respective hole 33 as described below. When the ends 22 and 23 are fitted to the seats 37 the handle 12 is virtually recessed in the front end wall 9. Each such fitting 34 is further formed with an outwardly projecting pin or hook 38 that can fit in the respective lead eye 32 for lifting of the front end of the case 1 as shown in FIGS. 3 and 4. When the handle is pulled from the body 2 upward parallel to the front end 9 these pins 38 will automatically hook in the holes 32 but when pulled out horizontally parallel to the top wall 7 this will not happen and the case 1 can be towed on all four wheels as seen in FIGS. 1 and 2.

As shown in FIGS. 12–15 a compartment 42 of a mechanism housing 48 inside the front end wall 9 has formations 41 that lock with the formations 40 of the fitting collar 39 of the lead 14. The formations 40 and 41 together allow the structure to accommodate different thicknesses of the wall 9 and another compartment 43 has formations 41 that accommodate the fitting 34 of the other lead 15. The housing 48 further has a central compartment 44 between the compartments 42 and 43 and an end compartment 57 outside the compartment 43. An integral lid or cover 46 having a membrane hinge 47 has barbs 49 that can fit into sockets 50 to close the housing 48 and a cutout 45 accommodates support elements of the case 1. Furthermore the housing 48 forms a pair of journals 51 and 52 for a shaft 56 of a windup support 53 having a pair of spools 54 and 55 seated in the compartments 42 and 43 and an end extension 61 in the compartment 57. The lead belts 14 and 15 are riveted at 63 to the respective spools 54 and 55. A spring 58 in the compartment 57 has one end 59 seated in a slot 60 of the end 61 of the support 53 and an opposite end 62 hooked over an edge of the housing 48. The spring 58 is tensioned to wind up the belt leads 14 and 15 in the respective compartments 42 and 43, thereby holding the handle 12 in the pockets 37 of the fittings 34.

Figure 16:
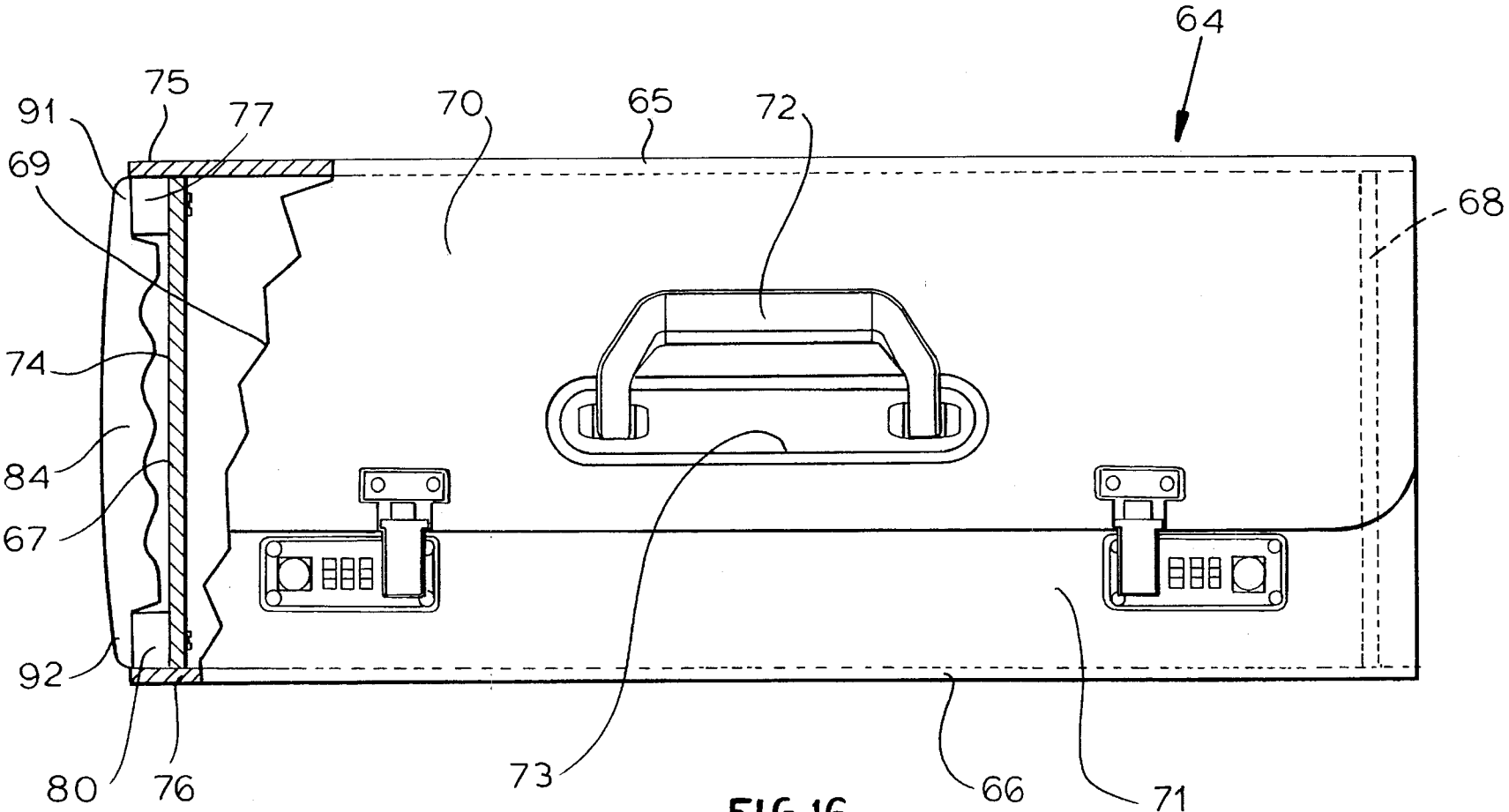
FIG. 16 is a partly sectional top view of another case according to the invention.
Figure 17:
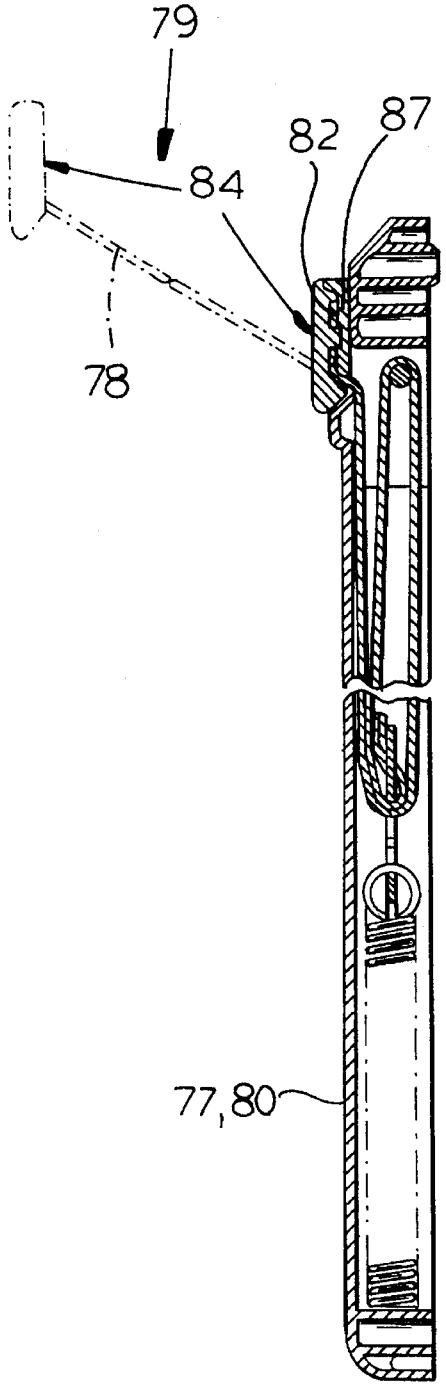
FIG. 17 is a vertical section through the lead mechanism of the case of FIG. 16.
Figure 18:
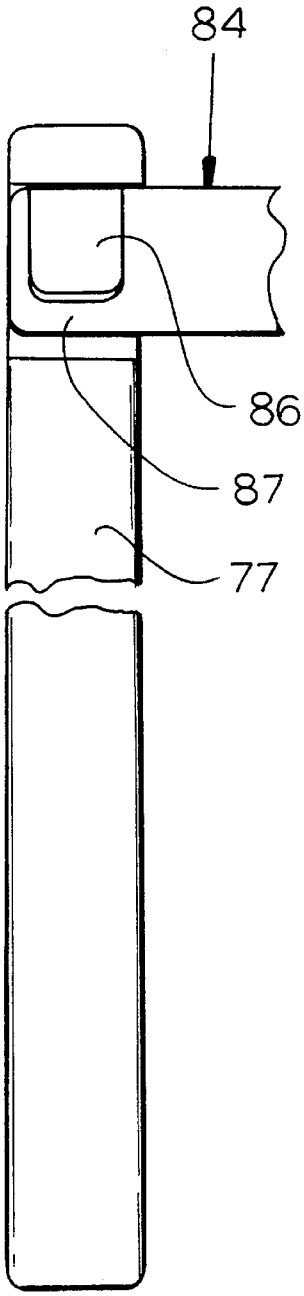
FIG. 18 is a front view of the structure of FIG. 17.
Figure 19:
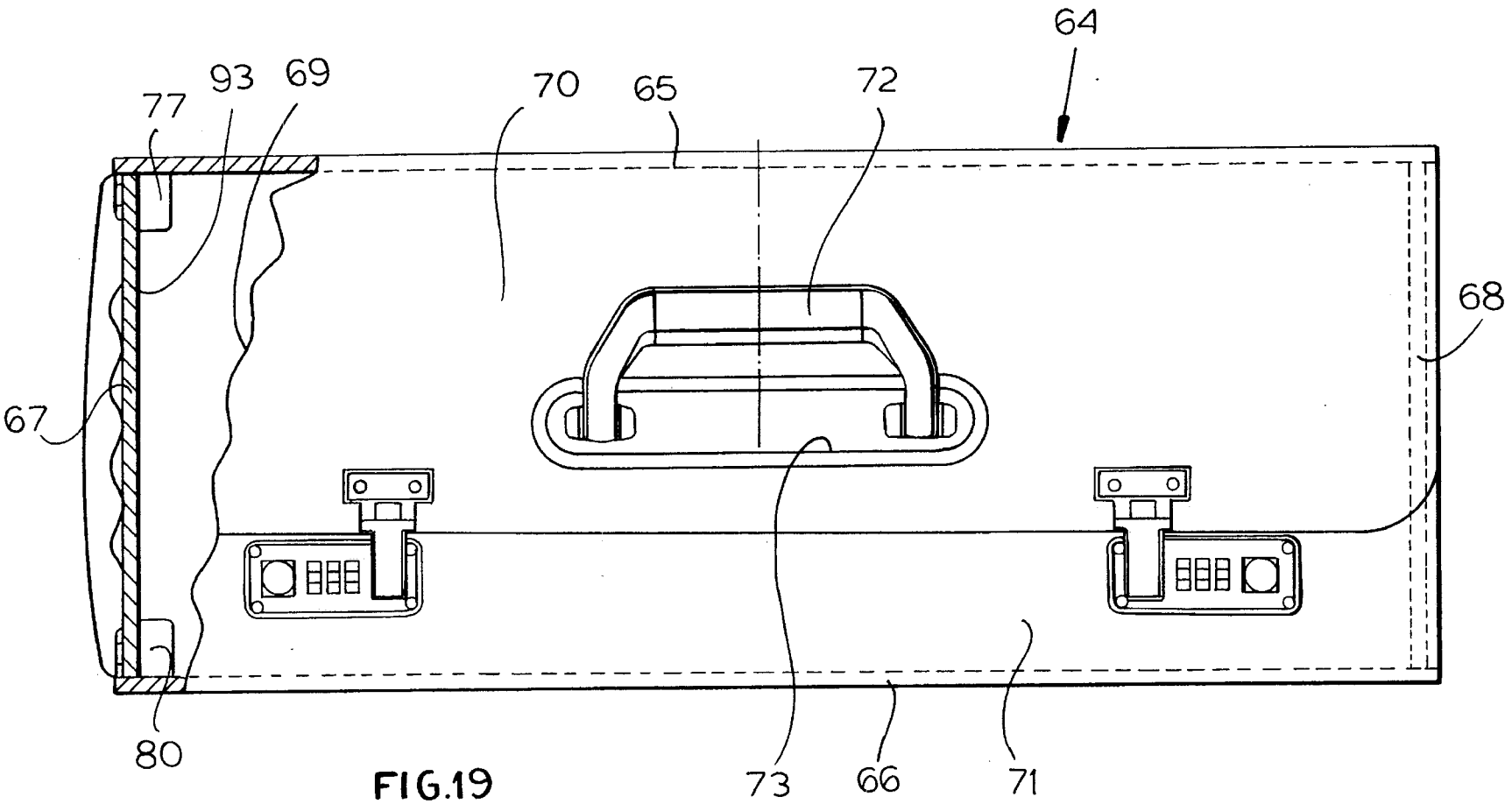
FIG. 19 is a view like FIG. 16 of another case according to the invention.

FIG. 16 shows a case 64 having a pair of sides 65 and 66, a pair of set-in ends 67 and 68, and a top wall 69 formed by two flaps 70 and 71. A handle 72 on the flap 71 fits through a hole 73 in the flap 70 as is standard for a so-called pilot's bag. An outer face 74 of the front end wall 67 is set in from extensions 75 and 76 of the side walls 65 and 66 and individual housings 77 and 80 are secured to this face 74 for winding up and paying out belt leads described below. FIG. 19 shows a similar arrangement with an end wall 67 that is not set in so that the housings 77 and 80 are mounted on an inside face 93 of this wall 67.

Here a lead assembly 79 has a handle 84 attached to the outer ends 82 of two identical belts 78 that extend to the respective housings 77 and 80. The handle 84 is formed by two parts 86 and 87 that sandwich the ends 82 that are formed with holes 85 through which a pin 88 of the part 86 passes to lodge in a recess 89 of the part 87, thereby effectively securing the belts 78 to the handle 84. The handle 84 has narrow ends 91 and 92 (see FIG. 16) so that when retracted it does not project significantly past the front end of the case 64.

Figure 20:
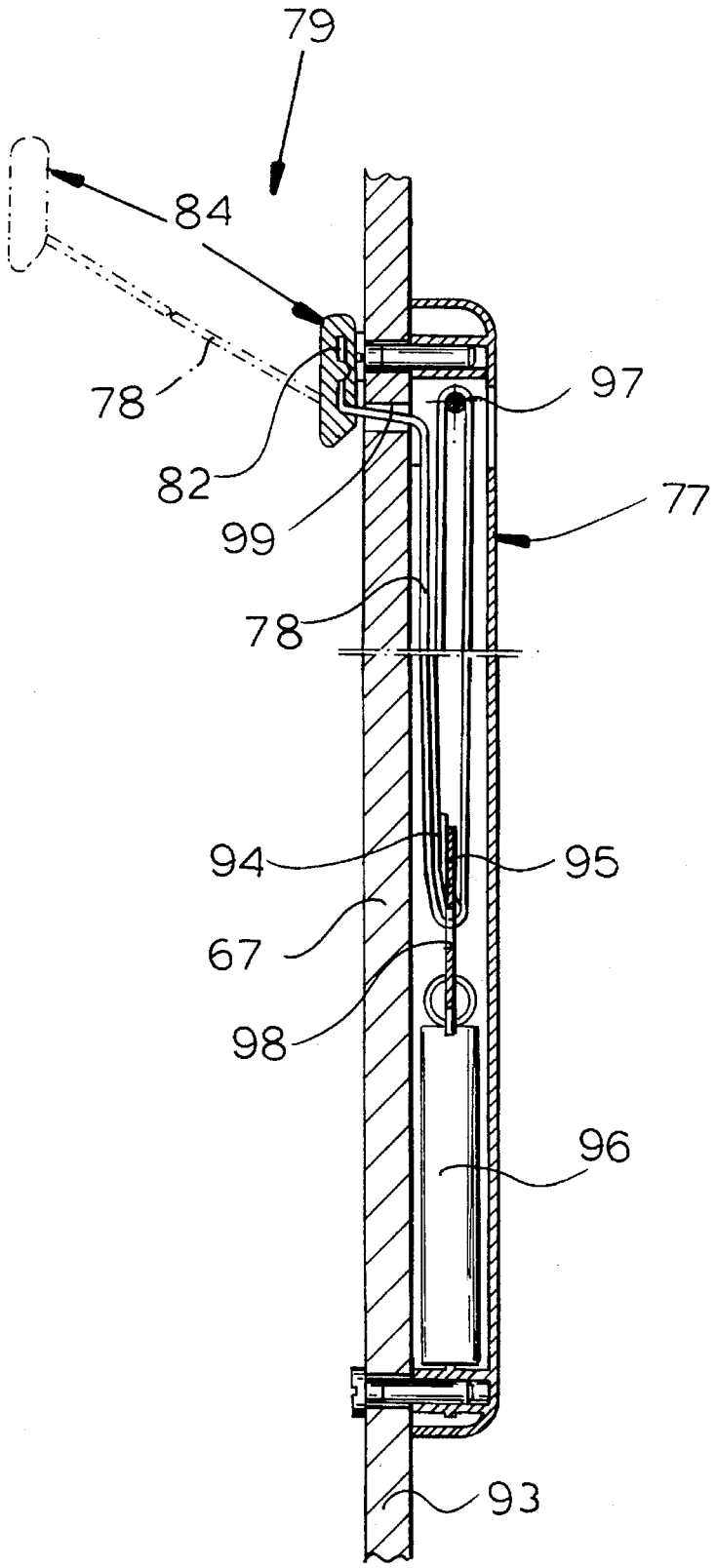
FIG. 20 is a view like FIG. 17 of the mechanism of the case of FIG. 19.
Figure 22:
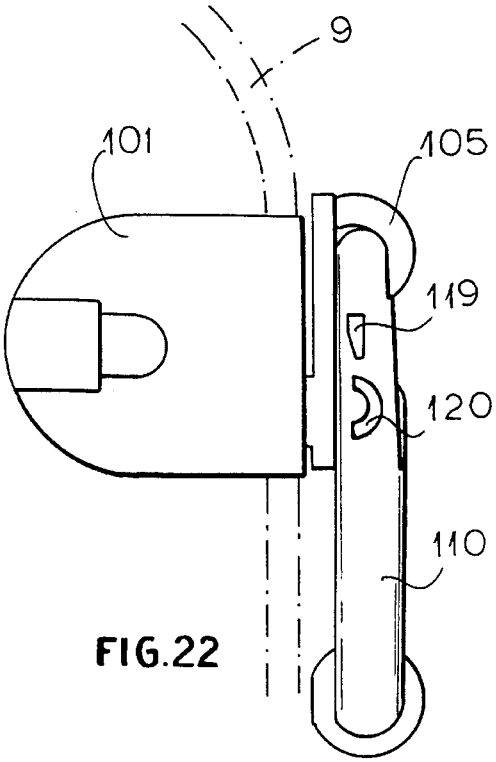
FIG. 22 is an end view of the mechanism of FIG. 21.
Figure 21:
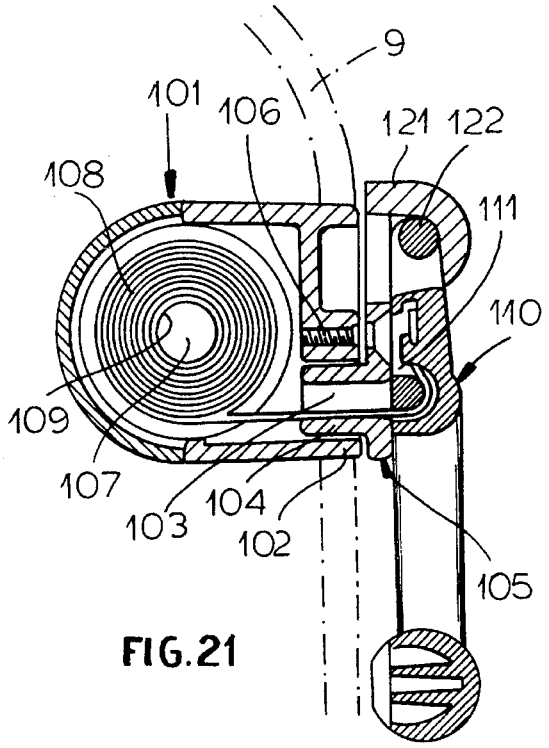
FIG. 21 is a vertical section through another lead mechanism according to the invention.

FIG. 20 shows how inside the housing 77 each belt 78 has an inner end 94 secured to a clip 95 carried on the free end of a coil spring 96 whose other end is anchored in the bottom of the housing 77. The belt 78 passes up from the clip 95 to an upper deflector roller or rod 97 and then down through a hole 98 in the clip 95 so that there is a 3:1 advantage for the spring 96, that is the belt moves 3 cm for each 1 cm of movement of the clip 95. The housing wall 67 is formed with ports 99 through which the belts 78 pass. Thus with this system as the handle 84 is pulled out the springs 96 will stretch, and when the handle 84 is released the springs 96 will pull the belts 78 back in.

The embodiment of FIGS. 21 through 25 has a mechanism housing 101 mounted inside the front end wall and having a front part 102 formed with a pair of apertures 103. Another front part 105 of the housing 101 has a collar 104 fitted into this aperture and one or more screws 106 secure the parts together on opposite sides of the wall 9. A pivot pin 107 in the housing 101 carries a pair of belts 108 whose inner ends 109 are fixed to the rod 107 and whose outer ends are fixed to a handle 110. To this end the handle 110 has C-shaped slots 111 defining a holding element 112 and projecting hooks 113 that engage through holes 115 in outer ends 114 of the belts 109, with tabs 118 overreaching and protecting these ends 114. Holes 119 and 120 in the end of the handle 110 facilitate assembly.

Figure 23:
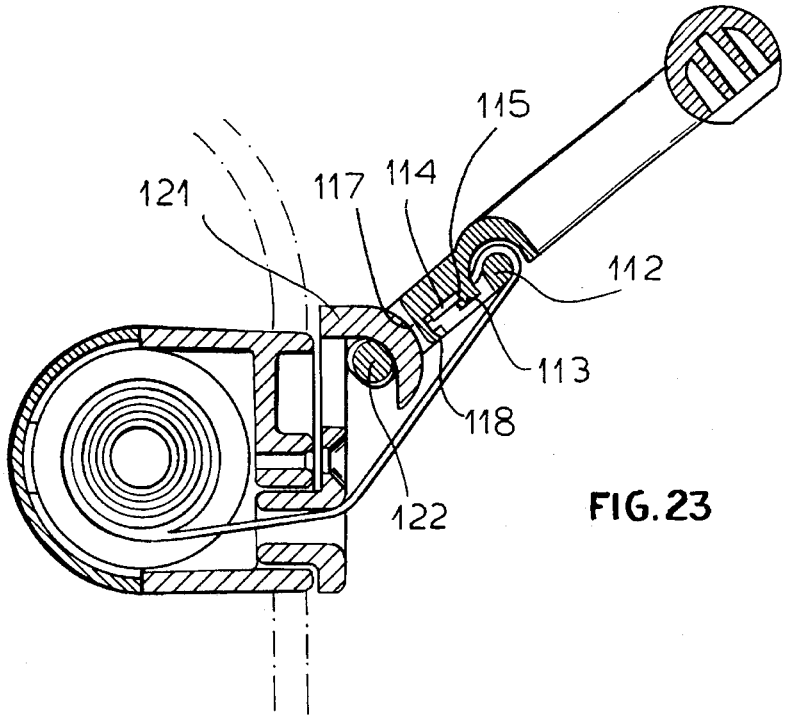
FIGS. 23 and 24 are views like FIG. 21 but in other operative positions.
Figure 24:
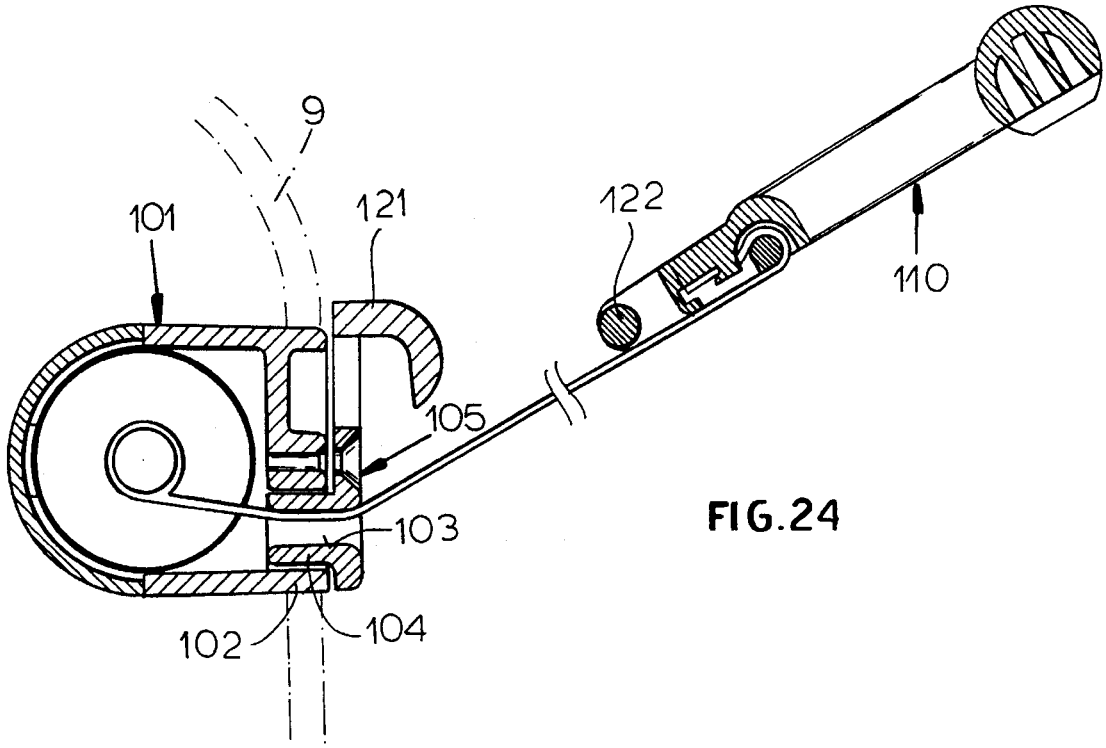
Figure 25:
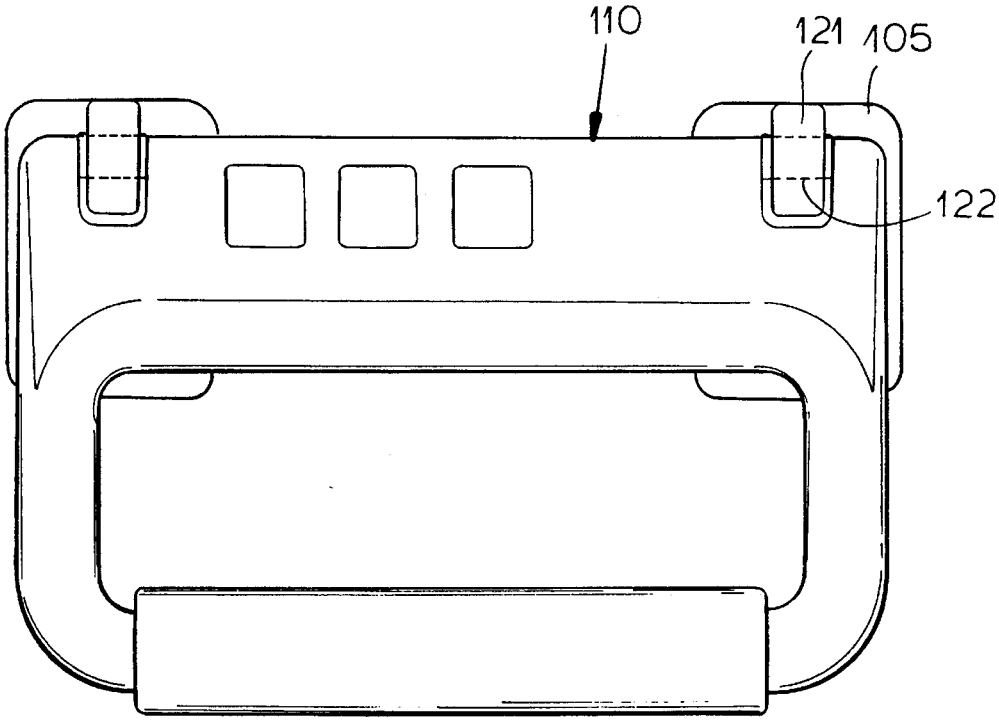
FIG. 25 is a front view of the mechanism of FIG. 21.

The housing 101 is formed with a pair of hooks 121 that can engage over upper pins 122 of the handle 110. Thus in the normal rest position the handle 110 lies against the front wall 9 with the belts 108 wound up and the rods 122 under the hooks 121. If the case is to be maneuvered only on its two rear wheels, the user merely pivots up the handle 110 as shown in FIG. 23, leaving the pins 122 in the hooks 121, and manipulates the case by the handle 110. To tow the bag, with it riding on all four of its wheels, the handle 110 is shifted downward and pulled out so that the hooks 121 disengage the rods 122 and the belts 108 can be extended as in FIG. 24. To return the system to the starting position the unillustrated spring is allowed to rewind the belts 108 while the pins 122 are fitted under the hooks 121, whereupon the belts 108 will pull the handle 110 flat against the face 9.

I claim:

1. A rolling travel case comprising:

a body having top and bottom sides, generally vertical front and back ends, and side faces;

a plurality of horizontally spaced wheels on the bottom side, whereby the body can be rolled via the wheels on the ground;

a handle having a pair of spaced anchor points defining a pair of spaced front locations;

a pair of flexible leads each having an inner end secured at a respective rear location on the front end and an outer end secured at a respective one of the front locations to the respective anchor point on the handle, the rear locations being spaced from each other;

respective housings at the rear locations; and respective spring means in the housings including at least one spring having one end secured to the respective lead and an opposite end to the respective housing for retracting the respective leads and pulling the handle against the front end.

2. The rolling travel case defined in claim 1 wherein the rear locations are horizontally spaced.

3. The rolling travel case defined in claim 2 wherein the case is generally symmetrical to a vertical symmetry plane generally equidistant between and parallel to the side faces and the rear locations symmetrically flank the plane.

4. The rolling travel case defined in claim 1 wherein the handle has a pair of deflector pins and hooks defining the front locations and anchor points, the leads passing around the respective pins and being caught on the respective hooks.

5. The rolling travel case defined in claim 1 wherein the handle has a pair of parts one of which has a pair of pins and the other of which has a pair of recesses receiving the pins and defining therewith the anchor points and front locations, the outer ends of the leads being engaged between the parts and traversed by the pins at the front locations.

6. The rolling travel case defined in claim 1 wherein each housing has a pair of parts one of which is mounted outside the body and the other of which is mounted inside the body, the housings each having fastening means securing the respective parts together to opposite sides of the front end.

7. The rolling travel case defined in claim 1 wherein the housings are mounted externally on the body.

8. The rolling travel case defined in claim 1 wherein the housings are mounted inside the body.

9. The rolling travel case defined in claim 1 wherein each spring is provided with a clip defining a hole and each housing has a deflector, each lead passing through the hole and over the deflector and having its inner end secured to the clip.

10. The rolling travel case defined in claim 1, further comprising a socket on the front end and positioned to receive the handle in a retracted position thereof.

11. The rolling travel case defined in claim 10 wherein the front end is provided with a pair of fittings defining seats forming the socket.

12. The rolling travel case defined in claim 1 wherein the front end is provided with a downwardly directed hook and the handle has at least one pivot part engageable with the hook for coupling of the handle directly to the body.

13. The rolling travel case defined in claim 12 wherein the front end has two such hooks spaced horizontally from each other and the handle has a pair of rods defining the pivot part and engageable with the respective hooks.

14. The rolling travel case defined in claim 1 wherein the leads are belts.

* * * * *